US008836689B2

(12) United States Patent
Miyake

(10) Patent No.: US 8,836,689 B2
(45) Date of Patent: Sep. 16, 2014

(54) DISPLAY DEVICE

(75) Inventor: Hiroyuki Miyake, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 224 days.

(21) Appl. No.: 13/560,133

(22) Filed: Jul. 27, 2012

(65) Prior Publication Data

US 2013/0033475 A1 Feb. 7, 2013

(30) Foreign Application Priority Data

Aug. 5, 2011 (JP) ..... 2011-172236

(51) Int. Cl.
*G09G 3/30* (2006.01)
*G09G 3/32* (2006.01)
*G09G 5/00* (2006.01)

(52) U.S. Cl.
CPC ..... *G09G 5/00* (2013.01)
USPC ..... 345/211; 345/76; 345/82; 345/204

(58) Field of Classification Search
USPC ..... 345/76, 82, 204
See application file for complete search history.

(56) References Cited

U.S. PATENT DOCUMENTS 5,550,066 A 8/1996 Tang et al.
5,684,365 A 11/1997 Tang et al.
6,661,180 B2 * 12/2003 Koyama ..... 315/169.3
6,958,750 B2 10/2005 Azami et al.
7,046,240 B2 * 5/2006 Kimura ..... 345/212
7,649,516 B2 1/2010 Azami et al.
7,859,491 B2 * 12/2010 Lee et al. ..... 345/76
8,054,250 B2 * 11/2011 Kim ..... 345/76
8,164,547 B2 * 4/2012 Kimura ..... 345/76
8,519,392 B2 * 8/2013 Yamazaki et al. ..... 257/57
2003/0117352 A1 * 6/2003 Kimura ..... 345/87
2004/0196239 A1 * 10/2004 Kwon ..... 345/92
2005/0057459 A1 * 3/2005 Miyazawa ..... 345/76
2005/0206593 A1 * 9/2005 Kwon ..... 345/76
2006/0103322 A1 * 5/2006 Chung et al. ..... 315/169.3
2007/0063993 A1 * 3/2007 Shishido ..... 345/175
2007/0064469 A1 * 3/2007 Umezaki ..... 365/154
2007/0126664 A1 * 6/2007 Kimura ..... 345/76
2009/0021539 A1 * 1/2009 Kimura ..... 345/690
2009/0051628 A1 * 2/2009 Kwon ..... 345/77
2012/0026145 A1 * 2/2012 Jeong ..... 345/211

FOREIGN PATENT DOCUMENTS

JP 8-241047 9/1996

* cited by examiner

*Primary Examiner* — Joe H Cheng
*Assistant Examiner* — Benyam Ketema
(74) *Attorney, Agent, or Firm* — Husch Blackwell LLP

(57) ABSTRACT

In a display device including a pixel in which a driving transistor and a light-emitting element connected to a source of the driving transistor are provided, a display defect is suppressed. Before a period in which the driving transistor supplies a current to the light-emitting element, a voltage which has substantially the same level as a voltage which is applied to one electrode and the other electrode of a capacitor is kept as a voltage between a gate and the source of the driving transistor in the period. Specifically, a node where the one electrode of the capacitor and the gate of the driving transistor are electrically connected to each other in the period is made in a floating state, and the other electrode of the capacitor and the source of the driving transistor are electrically connected to each other.

21 Claims, 6 Drawing Sheets at T1 at T2

DISPLAY DEVICE

BACKGROUND OF THE INVENTION

1. Field of the Invention

The present invention relates to a display device. In particular, the present invention relates to a display device including a light-emitting element which emits light utilizing electroluminescence.

2. Description of the Related Art

A display device including a light-emitting element which emits light utilizing electroluminescence has been developed as an active matrix display device. Specifically, a display device has been developed in which the light-emitting element is provided in each of pixels arranged in matrix and desired display is performed by appropriately controlling a current which is supplied to each light-emitting element. Examples of the light-emitting element include an element containing an organic material which emits light utilizing electroluminescence (also referred to as an organic EL element or an organic light-emitting diode).

For the display device, a means to control the current which is supplied to each light-emitting element are needed. As the means, a means to control a current which is supplied to a light-emitting element by using a transistor (also referred to as a driving transistor) is known (e.g., see Patent Document 1). In other words, the means are known in which a transistor whose source and drain are connected to a light-emitting element in series between a wiring for supplying a high power source potential VDD (also referred to as a high power supply potential line) and a wiring for supplying a low power supply potential VSS (also referred to as a low power supply potential line) is provided in each pixel.

As specific examples of a pixel including a light-emitting element and a driving transistor, structures illustrated in FIGS. 3A to 3D can be given. Specifically, a pixel illustrated in FIG. 3A includes an n-channel transistor 1001A whose drain is electrically connected to a high power supply potential line, and a light-emitting element 1002A whose anode is electrically connected to a source of the n-channel transistor 1001A and whose cathode is electrically connected to a low power supply potential line. A pixel illustrated in FIG. 3B includes a p-channel transistor 1001B whose source is electrically connected to a high power supply potential line, and a light-emitting element 1002E whose anode is electrically connected to a drain of the p-channel transistor 1001B and whose cathode is electrically connected to a low power supply potential line. A pixel illustrated in FIG. 3C includes an n-channel transistor 1001C whose source is electrically connected to a low power supply potential line, and a light-emitting element 1002C whose cathode is electrically connected to a drain of the n-channel transistor 1001C and whose anode is electrically connected to a high power supply potential line. A pixel illustrated in FIG. 3D includes a p-channel transistor 1001D whose drain is electrically connected to a low power supply potential line, and a light-emitting element 1002D whose cathode is electrically connected to a source of the p-channel transistor 1001D and whose anode is electrically connected to a high power supply potential line.

Of the pixels illustrated in FIGS. 3A to 3D, the pixel illustrated in FIG. 3B is most commonly used in consideration of the following two technical viewpoints.

The first viewpoint is a change in potential of a node where a driving transistor and a light-emitting element are electrically connected to each other, which is caused by deterioration of the light-emitting element over time or a change in environment temperature. Specifically, in the pixels illustrated in FIGS. 3B and 3C, the potential of the source of the driving transistor is kept constant. In other words, the voltage between the gate and the source of the driving transistor which is included in each of the pixels illustrated in FIGS. 3B and 3C can be kept irrespective of whether or not the light-emitting element deteriorates over time and the environment temperature is changed. Accordingly, in the pixels illustrated in FIGS. 3B and 3C, a current which is supplied to the light-emitting element at the time when the driving transistor is operated in a saturation region (a current flowing between the source and the drain of the driving transistor) can be kept substantially constant irrespective of whether or not the light-emitting element deteriorates over time and the environment temperature is changed. On the other hand, the potential of the source of the driving transistor included in each of the pixels illustrated in FIGS. 3A and 3D is changed in response to deterioration of the light-emitting element over time or a change in environment temperature. In other words, a voltage between the gate and the source of the driving transistor included in each of the pixels illustrated in FIGS. 3A and 3D is changed in response to the deterioration of the light-emitting element over time or the change in the environment temperature. Accordingly, in the pixels illustrated in FIGS. 3A and 3D, the current which is supplied to the light-emitting element is changed in response to the deterioration of the light-emitting element over time or the change in the environment temperature.

The second viewpoint is a manufacturing process. Each of the light-emitting elements included in the pixels illustrated in FIGS. 3A to 3D emits light which is generated by electroluminescence between a pair of electrodes (the anode and the cathode) to the outside. Therefore, at least one of the pair of electrodes needs to transmit light. For example, it is necessary that at least one of the pair of electrodes is formed using a light-transmitting material such as indium tin oxide (also referred to as ITO). Such a material is preferably used for an anode because of its relatively high work function. Further, such a material is generally formed by a sputtering method. However, in the case where the light-emitting element is an organic EL element, when the formation of the material is performed by a sputtering method after an organic material is formed, the organic material might be damaged. Therefore, in the manufacturing process of a driving circuit and a light emitting element, the following order is preferable: a driving transistor and an anode to be included in a light-emitting element are formed, and then an organic material to be included in the light-emitting element is formed. Here, it is possible to easily form the driving transistors and the light emitting elements in the pixels illustrated in FIGS. 3A and 3B in accordance with the above order.

In short, the pixel configurations illustrated in FIGS. 3B and 3C are convenient from the first viewpoint, and the pixel configurations illustrated in FIGS. 3A and 3B are convenient from the second viewpoint. Accordingly, the use of the pixel configuration illustrated in FIG. 3B as the configuration of a pixel in a display device is convenient from the two viewpoints.

REFERENCE

[Patent Document 1] Japanese Published Patent Application No. H08-241047

SUMMARY OF THE INVENTION

A problem to be solved in one embodiment of the present invention is the one which might occur in the pixels illustrated in FIGS. 3A and 3D from the first viewpoint.

One embodiment of the present invention is described below with reference to FIGS. 1A to 1C. Note that FIG. 1A illustrates an example in which the pixel configuration illustrated in FIG. 3A is employed for a pixel of a display device. FIG. 1B illustrates an example of a driving method of the pixel illustrated in FIG. 1A in a period T1 (also referred to as a writing period). FIG. 1C illustrates an example of a driving method of the pixel illustrated in FIG. 1A in a period T2 (also referred to as a display period). Note that the period T2 follows the period T1.

The pixel illustrated in FIG. 1A includes an n-channel transistor 1 whose gate is electrically connected to a terminal A and whose drain is electrically connected to a high power supply potential line; a light-emitting element 2 whose cathode is electrically connected to a low power supply potential line; a capacitor 3 one electrode of which is electrically connected to a terminal B and the other electrode of which is electrically connected to a source of the n-channel transistor 1; a constant current source 4; a switch 5 one terminal of which is electrically connected to the gate of the n-channel transistor 1 and the other terminal of which is electrically connected to the one electrode of the capacitor 3; a switch 6 one terminal of which is electrically connected to the source of the n-channel transistor 1 and the other terminal of which is electrically connected to an anode of the light-emitting element 2; and a switch 7 one terminal of which is electrically connected to the source of the n-channel transistor 1 and the other electrode of the capacitor 3, and the other terminal of which is electrically connected to the constant current source 4. Note that the constant current source 4 is a current source which steadily generates a current $i_0$.

In the period T1 (see FIG. 1B), the switches 5 and 6 are off and the switch 7 is on. In addition, a saturation region operation potential $V_0$ is input from the terminal A to the gate of the n-channel transistor 1. Further, an image signal $V_{data}$ is input to the one electrode of the capacitor 3 from the terminal B. Note that the saturation region operation potential $V_0$ refers to a potential at which the n-channel transistor 1 is operated in the saturation region. In such a case, the current $i_0$ is generated between the drain and the source of the n-channel transistor 1. Since the n-channel transistor 1 is operated in the saturation region, the current $i_0$ is expressed as follows.

[Formula 1]

$$i_0 = \frac{k}{2}\mu(V_{gs} - V_{th})^2 \tag{1}$$

Note that μ represents the mobility of the n-channel transistor 1, $V_{gs}$ represents the voltage between the gate and the source of the n-channel transistor 1, and $V_{th}$ represents the threshold voltage of the n-channel transistor 1. Further, k is expressed as follows.

[Formula 2]

$$k = \frac{W}{L}C_{ox} \tag{2}$$

Note that W represents the channel width of the n-channel transistor 1, L represents the channel length of the n-channel transistor 1, and $C_{ox}$ represents the gate capacitance of the n-channel transistor 1.

The image signal $V_{data}$ is input to the one electrode of the capacitor 3, and the other electrode of the capacitor 3 is electrically connected to the source of the n-channel transistor 1. Accordingly, a voltage $V_C$ between the one electrode and the other electrode of the capacitor 3 is expressed as follows. Note that the potential of the source of the n-channel transistor 1 can be expressed as $V_0 - V_{gs}$.

[Formula 3]

$$V_C = V_{data} - (V_0 - V_{gs}) \tag{3}$$

Here, from Formula (1), the voltage between the gate and the source of the n-channel transistor 1 is expressed as follows.

[Formula 4]

$$V_{gs} = \sqrt{\frac{2i_0}{k\mu}} + V_{th} \tag{4}$$

In addition, from Formulae (3) and (4), the voltage $V_C$ is expressed as follows.

[Formula 5]

$$V_C = V_{data} - V_0 + \sqrt{\frac{2i_0}{k\mu}} + V_{th} \tag{5}$$

Next, in the period T2 (see FIG. 1C), the switches 5 and 6 are on and the switch 7 is off. In addition, the terminals A and B are in a high impedance state Z. Accordingly, a node where the gate of the n-channel transistor 1 and the one electrode of the capacitor 3 are electrically connected to each other is made in a floating state, whereby the charge of the node is kept. In general, the gate capacitance of the n-channel transistor 1 is extremely lower than the storage capacitance of the capacitor 3. Therefore, the potential of the node has substantially the same level as the potential of the one electrode of the capacitor 3 in the period T1. In addition, the voltage between the one electrode and the other electrode of the capacitor 3 is kept. Accordingly, the voltage between the gate and the source of the n-channel transistor 1 has substantially the same level as the voltage $V_C$ between the one electrode and the other electrode of the capacitor 3 in the period T1 independently of the potential of the source of the n-channel transistor 1. In this case, a current I between the drain and the source of the n-channel transistor 1 (a current supplied to the light-emitting element 2) is expressed as follows.

[Formula 6]

$$I \approx \frac{k}{2}\mu(V_C - V_{th})^2 \tag{6}$$

Here, from Formula (5), the current I is expressed as follows.

[Formula 7]

$$I \approx \frac{k}{2}\mu\left(V_{data} - V_0 + \sqrt{\frac{2i_0}{k\mu}}\right)^2 \tag{7}$$

As shown in Formula (7), the current I, which is supplied to the light-emitting element 2, is independent of the potential of the source of the n-channel transistor 1 in the display device according to one embodiment of the present invention.

In addition, as shown in Formula (7), the current I is also independent of the threshold voltage of the n-channel transistor 1 in the display device according to one embodiment of the present invention.

In addition, even in the case where the mobility of the n-channel transistor 1 varies, it is possible to reduce a change in the current supplied to the light-emitting element 2. This point is described below in detail. Note that a current which is supplied to the light-emitting element 2 in the case where the mobility is increased to $\mu+\Delta\mu$ is described below. In addition, the value of $\Delta\mu$ is extremely lower than the value of $\mu(\mu>>\Delta\mu u)$. In this case, from Formula (5), the voltage between the one electrode and the other electrode of the capacitor 3 in the period T1 is expressed as follows.

[Formula 8]

$$V_{data} - V_0 + \sqrt{\frac{2i_0}{k(\mu+\Delta\mu)}} + V_{th} \tag{8}$$

Here, Formula (8) is expressed as follows according to Taylor expansion.

[Formula 9]

$$V_{data} - V_0 + \left(\sqrt{\frac{2i_0}{k\mu}} - \sqrt{\frac{i_0}{2k\mu}}\frac{\Delta\mu}{\mu} + \ldots\right) + V_{th} \approx V_{data} - V_0 + \sqrt{\frac{2i_0}{k\mu}} + V_{th} - \sqrt{\frac{i_0}{2k\mu}}\frac{\Delta\mu}{\mu} \tag{9}$$

In this case, from Formulae (6) and (9), the current supplied to the light-emitting element 2 is expressed as follows.

[Formula 10]

$$\frac{k}{2}(\mu+\Delta\mu)\left(V_{data} - V_0 + \sqrt{\frac{2i_0}{k\mu}} - \sqrt{\frac{i_0}{2k\mu}}\frac{\Delta\mu}{\mu}\right)^2 \tag{10}$$

As shown in Formula (10), when the mobility of the n-channel transistor 1 is increased, the current supplied to the light-emitting element 2 equals the product of a formula whose value is increased and a formula whose value is reduced. Namely, in the display device according to one embodiment of the present invention, even when the mobility of the n-channel transistor 1 varies, a change in the current supplied to the light-emitting element 2 can be reduced.

In addition, even in the case where the driving transistor is a normally-on transistor, the current I supplied to the light-emitting element 2 is independent of the potential of the source of the n-channel transistor 1 and the threshold voltage of the n-channel transistor 1. This point is described below in detail. Note that a normally-on transistor in this specification refers to a transistor whose threshold voltage has a negative value. In that case, the potential of the source of the n-channel transistor 1 in the period T1 can be expressed as $V_0+|V_{th}|$. Note that a relation of $V_0+|V_{th}|\leq VDD$ is satisfied. Accordingly, the voltage $V_C$ between the one electrode and the other electrode of the capacitor 3 in that case is expressed as follows.

[Formula 11]

$$V_C = V_{data} - (V_0 + |V_{th}|) \tag{11}$$

In that case, the current I is expressed as follows.

[Formula 12]

$$I \approx \frac{k}{2}\mu(V_C + |V_{th}|)^2 \tag{12}$$

In addition, from Formula (11), the current I is expressed as follows.

[Formula 13]

$$I \approx \frac{k}{2}\mu(V_{data} + V_0)^2 \tag{13}$$

As shown in Formula (13), even when the n-channel transistor 1 is a normally-on transistor, the current I supplied to the light-emitting element 2 is independent of the potential of the source of the n-channel transistor 1 and the threshold voltage of the n-channel transistor 1 in the display device according to one embodiment of the present invention.

The description made above is one embodiment of the present invention. Note that the description made with reference to FIGS. 1A to 1C and FIGS. 3A to 3D explains only one example of the present invention, and needless to say, the present invention is not limited to the description.

The above-described embodiment of the present invention can be expressed as a display device including a light-emitting element, an n-channel driving transistor, a capacitor, a constant current source, a first switch, a second switch, and a third switch. In the display device, one terminal of the first switch is electrically connected to a gate of the driving transistor and the other terminal of the first switch is electrically connected to one electrode of the capacitor; one terminal of the second switch is electrically connected to a source of the driving transistor, and the other terminal of the second switch is electrically connected to an anode of the light-emitting element; one terminal of the third switch is electrically connected to the source of the driving transistor and the other electrode of the capacitor, and the other terminal of the third switch is electrically connected to the constant current source; in a writing period, the first switch and the second switch are off, the third switch is on, the driving transistor is operated in a saturation region, an image signal is input to the one electrode of the capacitor, and a potential which has substantially the same level as a potential of the source of the driving transistor is input to the other electrode of the capacitor; and in a display period after the writing period, the first switch and the second switch are on, the third switch is off, a node where the one electrode of the capacitor and the gate of the driving transistor are electrically connected to each other is made in a floating state, a voltage which has substantially the same level as a difference between the image signal and the potential of the source of the driving transistor in the writing period is kept as a voltage between the gate and the source of the driving transistor.

Note that the pixel configuration illustrated in FIG. 3D may be employed for the pixel of the display device of one embodiment of the present invention. Specifically, even when the pixel configuration illustrated in FIG. 2 is employed, the above-described operation can be carried out. The pixel illustrated in FIG. 2 includes a p-channel transistor 8 whose gate is electrically connected to the terminal A and whose drain is electrically connected to a low power supply potential line; a light-emitting element 9 whose anode is electrically connected to a high power supply potential line; the capacitor 3 one electrode of which is electrically connected to the terminal B and the other electrode of which is electrically connected to a source of the p-channel transistor 8; the constant current source 4; the switch 5 one terminal of which is electrically connected to the gate of the p-channel transistor 8 and the other terminal of which is electrically connected to the one electrode of the capacitor 3; the switch 6 one terminal of which is electrically connected to the source of the p-channel transistor 8 and the other terminal of which is electrically connected to a cathode of the light-emitting element 9; and the switch 7 one terminal of which is electrically connected to the source of the p-channel transistor 8 and the other electrode of the capacitor 3, and the other terminal of which is electrically connected to the constant current source 4.

In this case, one embodiment of the present invention can be expressed as a display device including a light-emitting element, a p-channel driving transistor, a capacitor, a constant current source, a first switch, a second switch, and a third switch. In the display device, one terminal of the first switch is electrically connected to a gate of the driving transistor, and the other terminal of the first switch is electrically connected to one electrode of the capacitor; one terminal of the second switch is electrically connected to a source of the driving transistor, and the other terminal of the second switch is electrically connected to a cathode of the light-emitting element; one terminal of the third switch is electrically connected to the source of the driving transistor and the other electrode of the capacitor, and the other terminal of the third switch is electrically connected to the constant current source; in a writing period, the first switch and the second switch are off, the third switch is on, the driving transistor is operated in a saturation region, an image signal is input to the one electrode of the capacitor, and a potential which has substantially the same level as a potential of the source of the driving transistor is input to the other electrode of the capacitor; and in a display period after the writing period, the first switch and the second switch are on, the third switch is off, a node where the one electrode of the capacitor and the gate of the driving transistor are electrically connected to each other is made in a floating state, a voltage which has substantially the same level as a difference between the image signal and a potential of the source of the driving transistor in the writing period is kept as a voltage between the gate and the source of the driving transistor.

As shown in Formula (7), the current supplied to the light-emitting element is independent of the potential of the source of the driving transistor in the display device according to one embodiment of the present invention. Accordingly, in the case where the source of the driving transistor and the light-emitting element are electrically connected to each other, even when the light-emitting element deteriorates over time or the environment temperature is changed, the current supplied to the light-emitting element can be kept substantially constant.

In addition, as shown in Formula (7), the current supplied to the light-emitting element is independent of the threshold voltage of the driving transistor in the display device according to one embodiment of the present invention. Accordingly, even when there are variations in threshold voltage among driving transistors which are provided in respective pixels arranged in matrix or even when the threshold voltage of the driving transistor is changed because of the deterioration, the current supplied to the light-emitting element can be kept substantially constant.

Furthermore, as shown in Formula (10), a change in the current supplied to the light-emitting element which is caused by an increase in the mobility of the driving transistor can be reduced in the display device according to one embodiment of the present invention. Therefore, even when there are variations in mobility among the driving transistors which are provided in respective pixels arranged in matrix, a change in the current supplied to the light-emitting element can be reduced.

Moreover, as shown in Formula (13), in the case where the driving transistor is a normally-on transistor, the current supplied to the light-emitting element is independent of the potential of the source of the driving transistor and the threshold voltage of the driving transistor in the display device according to one embodiment of the present invention. Therefore, even in the case where the driving transistor is a normally-on transistor, the above effect can be obtained.

DETAILED DESCRIPTION OF THE INVENTION

Embodiments of the present invention will be described below in detail. Note that the present invention is not limited to the description below, and a variety of changes can be made without departing from the spirit and scope of the present invention. Therefore, the invention should not be construed as being limited to the description below.

A configuration example of a display device according to one embodiment of the present invention will be described with reference to FIGS. 4A and 4B and FIGS. 5A and 5B.

Figure 4A:
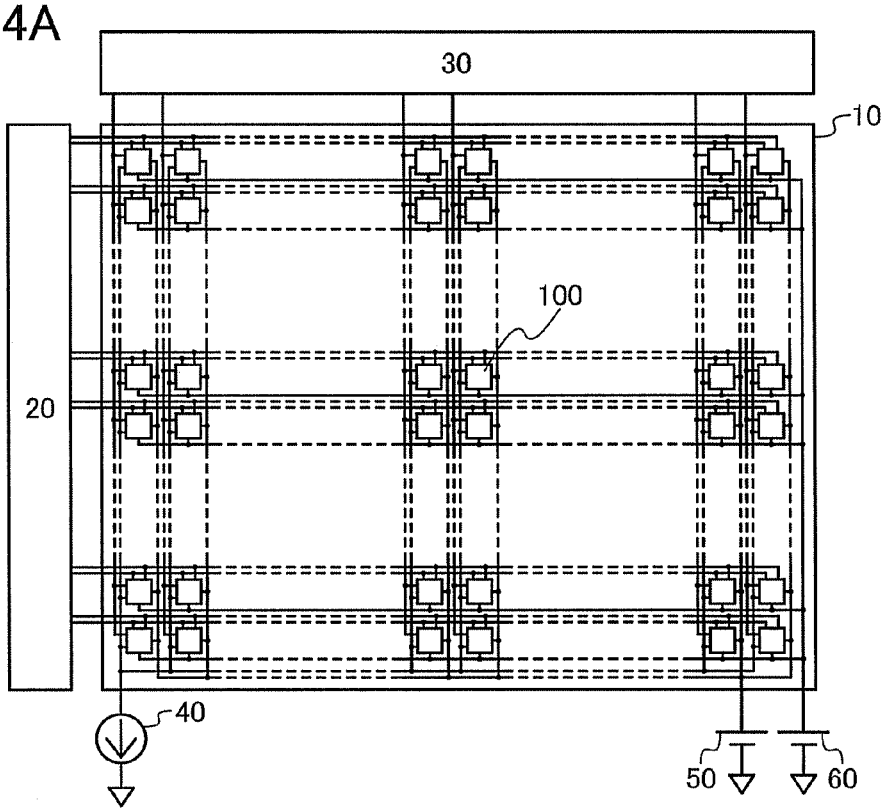
FIGS. 4A and 4B illustrate a configuration example of a display device.
Figure 4B:
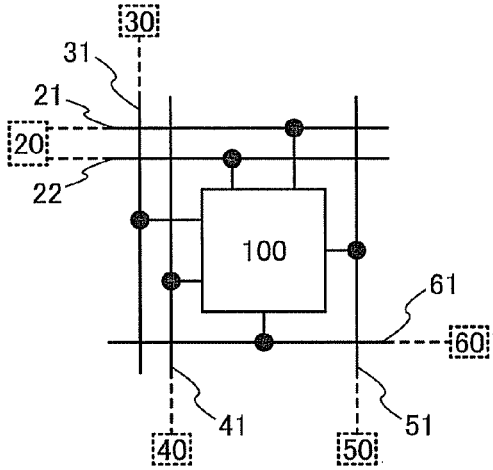

FIGS. 4A and 4B illustrate a configuration example of a display device. FIG. 4B illustrates part of FIG. 4A. The display device illustrated in FIGS. 4A and 4B includes a pixel portion 10 including a plurality of pixels 100 arranged in matrix, a gate driver 20 which is electrically connected to the plurality of pixels 100 via respective wirings 21 and 22 which are provided in each row, a source driver 30 which is electrically connected to the plurality of pixels 100 via respective wirings 31 which is provided in each column, a constant current source 40 which is electrically connected to the plurality of pixels 100 via a wiring 41, a constant voltage source 50 which is electrically connected to the plurality of pixels 100 via a wiring 51, and a constant voltage source 60 which is electrically connected to the plurality of pixels 100 via a wiring 61.

The constant voltage source 50 has a function of supplying a high power supply potential VDD to the wiring 51, and the constant voltage source 60 has a function of supplying a potential $V_0$ which is lower than the high power supply potential VDD to the wiring 61.

Figure 5A:
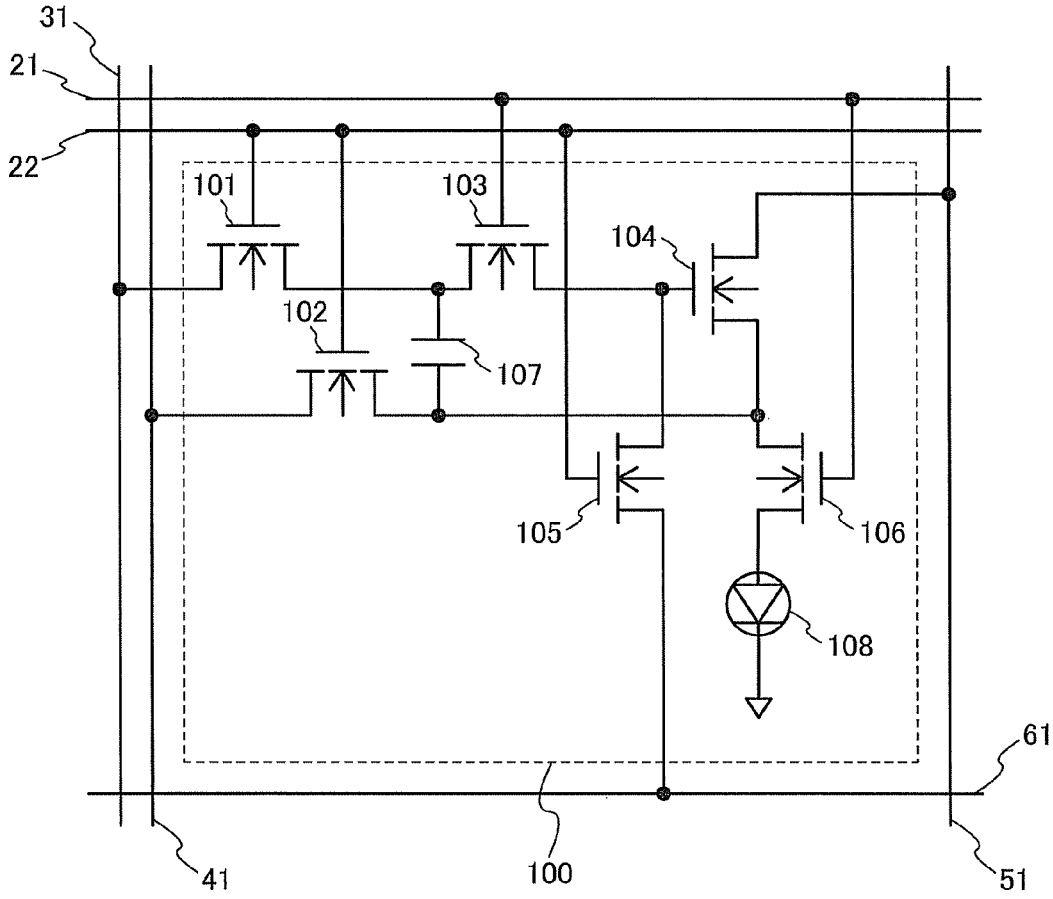
FIG. 5A illustrates a configuration example of a pixel.

FIG. 5A illustrates a configuration example of the pixel 100 illustrated in FIGS. 4A and 4B. The pixel 100 illustrated in FIG. 5A includes n-channel transistors 101 to 106, a capacitor 107, and a light-emitting element 108.

A gate of the n-channel transistor 101 is electrically connected to the wiring 22. One of a source and a drain of the n-channel transistor 101 is electrically connected to the wiring 31.

A gate of the n-channel transistor 102 is electrically connected to the wiring 22. One of a source and a drain of then-channel transistor 102 is electrically connected to the wiring 41.

A gate of the n-channel transistor 103 is electrically connected to the wiring 21. One of a source and a drain of the n-channel transistor 103 is electrically connected to the other of the source and the drain of the n-channel transistor 101.

A gate of the n-channel transistor 104 is electrically connected to the other of the source and the drain of the n-channel transistor 103. A source of the n-channel transistor 104 is electrically connected to the other of the source and the drain of the n-channel transistor 102. A drain of the n-channel transistor 104 is electrically connected to the wiring 51.

A gate of the n-channel transistor 105 is electrically connected to the wiring 22. One of a source and a drain of the n-channel transistor 105 is electrically connected to the other of the source and the drain of the n-channel transistor 103 and the gate of the n-channel transistor 104. The other of the source and the drain of the n-channel transistor 105 is electrically connected to the wiring 61.

A gate of the n-channel transistor 106 is electrically connected to the wiring 21. One of a source and a drain of the n-channel transistor 106 is electrically connected to the other of the source and the drain of the n-channel transistor 102 and the source of the n-channel transistor 104.

One electrode of the capacitor 107 is electrically connected to the other of the source and the drain of the n-channel transistor 101 and the one of the source and the drain of the n-channel transistor 103. The other electrode of the capacitor 107 is electrically connected to the other of the source and the drain of the n-channel transistor 102, the source of the n-channel transistor 104, and the one of the source and the drain of the n-channel transistor 106.

An anode of the light-emitting element 108 is electrically connected to the other of the source and the drain of the n-channel transistor 106. A cathode of the light-emitting element 108 is electrically connected to the low power supply potential line.

Figure 1A:
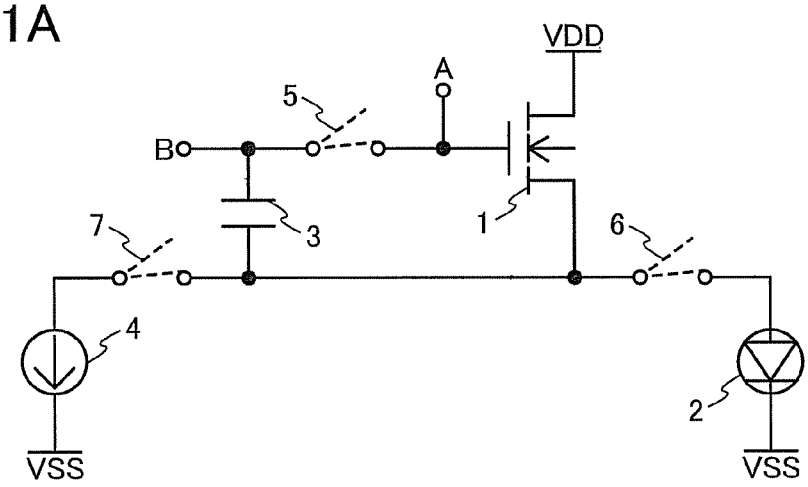
FIG. 1A illustrates a configuration example of a pixel.
Figure 1B:
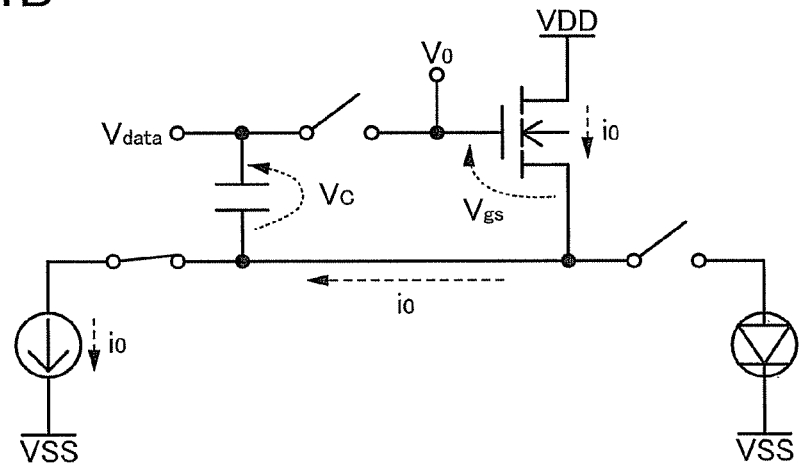
FIGS. 1B and 1C illustrate an example of a driving method of the pixel.
Figure 1C:
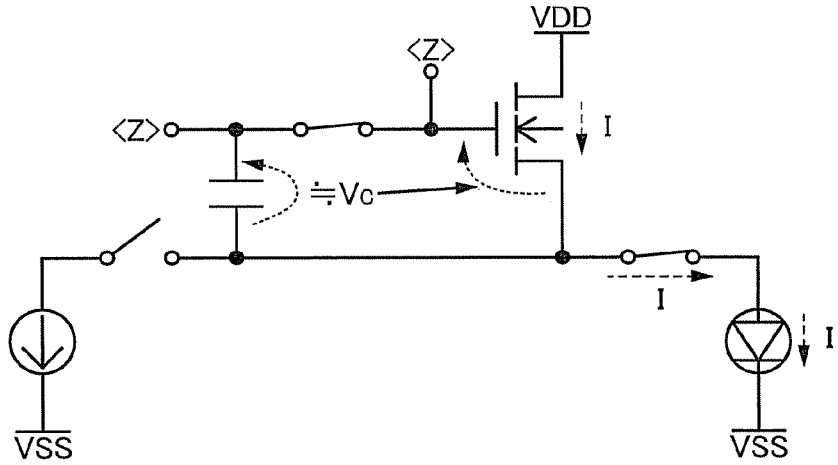
Figure 2:
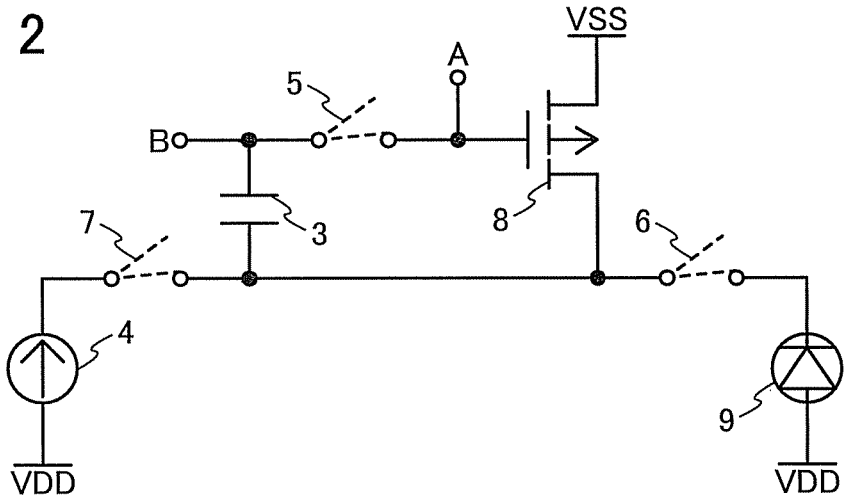
FIG. 2 illustrates a configuration example of a pixel.
Figure 3A:
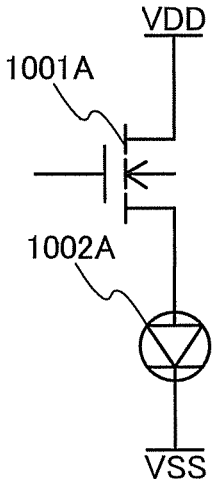
FIGS. 3A to 3D each illustrate a configuration example of a pixel.
Figure 3B:
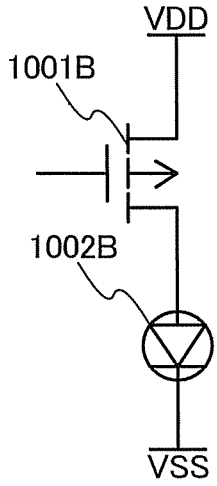
Figure 3C:
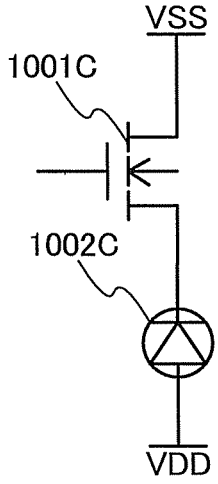
Figure 3D:
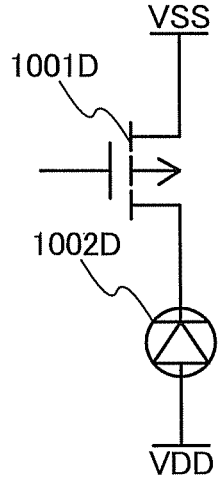

Note that in the pixel 100 illustrated in FIG. 5A, the n-channel transistor 104 functions as a driving transistor, and the n-channel transistors 101, 102, 103, 105, and 106 function as switches. Specifically, the n-channel transistor 104 corresponds to the n-channel transistor 1 in FIG. 1A, the n-channel transistor 103 corresponds to the switch 5 in FIG. 1A, the n-channel transistor 106 corresponds to the switch 6 in FIG. 1A, and the n-channel transistor 102 corresponds to the switch 7 in FIG. 1A.

Figure 5B:
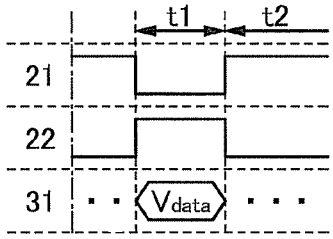
FIG. 5B is a timing chart showing signals input to the pixel.

FIG. 5B is a timing chart showing signals which are input to the pixel illustrated in FIG. 5A. Specifically, the timing chart shows signals supplied to the wirings 21, 22 and 31.

In a period t1 (also referred to as a writing period), a low-level potential is supplied to the wiring 21. Therefore, the n-channel transistors 103 and 106 are turned off. Further, a high-level potential is supplied to the wiring 22. Thus, the n-channel transistors 101, 102, and 105 are turned on. Furthermore, the image signal $V_{data}$ is supplied to the wiring 31.

In this case, the gate of the n-channel transistor 104 is electrically connected to the wiring 61 via the n-channel transistor 105. As a result, the potential $V_0$ is input to the gate of the n-channel transistor 104. Note that the potential $V_0$ is a potential at which the n-channel transistor 104 is operated in a saturation region. Further, the source of the n-channel transistor 104 is electrically connected to the constant current source 40 via the n-channel transistor 102. Accordingly, a predetermined current is generated between the drain and the source of the n-channel transistor 104.

In addition, the one electrode of the capacitor 107 is electrically connected to the wiring 31 via the n-channel transistor 101. Therefore, the image signal $V_{data}$ is input to the one electrode of the capacitor 107. Further, a potential which has substantially the same level as the potential of the source of the n-channel transistor 104 is input to the other electrode of the capacitor 107. Thus, the voltage ($V_C$) between the pair of electrodes of the capacitor 107 becomes substantially equal to a difference between the image signal $V_{data}$ and the potential of the source of the n-channel transistor 104.

In a period t2 (also referred to as a display period), a high-level potential is supplied to the wiring 21. Therefore, the n-channel transistors 103 and 106 are turned on. In addition, a low-level potential is supplied to the wiring 22. Thus, the n-channel transistors 101, 102, and 105 are turned off.

In this case, the gate of the n-channel transistor 104 is electrically connected to the one electrode of the capacitor 107 via the n-channel transistor 103. In addition, a node where the gate of the n-channel transistor 104 and the one electrode of the capacitor 107 are electrically connected to each other is made in a floating state. Accordingly, a charge existing in the node in the period t1 is also kept in the node in the period t2. Further, the voltage between the pair of electrodes of the capacitor 107 in the period t1 is kept as a voltage between the pair of electrodes of the capacitor 107 in the period t2. Note that the value of the gate capacitance of the n-channel transistor 104 is extremely lower than the value of the electrostatic capacitance of the capacitor 107. Here, the voltage between the pair of electrodes of the capacitor 107 becomes equal to a voltage between the gate and the source of the n-channel transistor 104. Accordingly, the voltage between the gate and the source of the n-channel transistor 104 in the period t2 is independent of the potential of the source of the n-channel transistor 104 and the threshold voltage of the n-channel transistor 104. As a result, even when the light-emitting element 108 provided in the pixel 100 deteriorates over time or the environment temperature is changed, or even when the threshold voltage of the n-channel transistor 104 provided in each of the pixels 100 varies, substantially the same current can be supplied to the light-emitting element 108 from the n-channel transistor 104 provided in each of the pixels 100.

In addition, even when the mobility of the n-channel transistor 104 provided in each of the pixels 100 varies, a change in the current supplied to the light-emitting element 108 can be reduced in the display device illustrated in FIGS. 4A and 4B and FIGS. 5A and 5B.

Further, in the display device illustrated in FIGS. 4A and 4B and FIGS. 5A and 5B, even when the n-channel transistor 104 provided in each of the pixels 100 is a normally-on transistor, the current supplied to the light-emitting element 108 can be kept substantially constant.

Furthermore, in the display device illustrated in FIGS. 4A and 4B and FIGS. 5A and 5B, all of the transistors provided in the pixels 100 are n-channel transistors. Therefore, the number of manufacturing steps is reduced, which enables a reduction in the manufacturing cost and an improvement in yield.

In addition, in the display device illustrated in FIGS. 4A and 4B and FIGS. 5A and 5B, each of the pixels 100 can be formed with transistors in which a channel is formed in an oxide semiconductor. Note that the transistor in which the channel is formed in the oxide semiconductor can be formed through a low-temperature process which is similar to that of a transistor in which a channel is formed in amorphous silicon, and has an advantage of having higher mobility than the transistor in which the channel is formed in amorphous silicon.

In addition, even when the n-channel transistor 104 (driving transistor) which is arranged in each of the pixels 100 is a normally-on transistor, the current supplied to the light-emitting element 108 can be kept substantially constant in the display device illustrated in FIGS. 4A and 4B and FIGS. 5A and 5B.

EXAMPLE 1

In this example, examples of electronic appliances each including the above display device will be described with reference to FIGS. 6A to 6F.

Figure 6A:
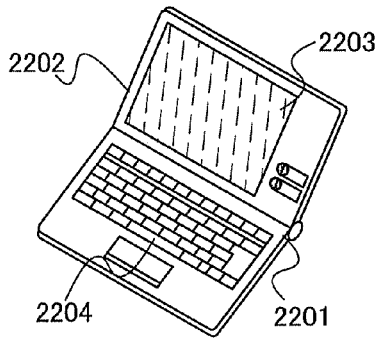
FIGS. 6A to 6F illustrate examples of electronic appliances.

FIG. 6A illustrates a laptop computer, which includes a main body 2201, a housing 2202, a display portion 2203, a keyboard 2204, and the like.

Figure 6B:
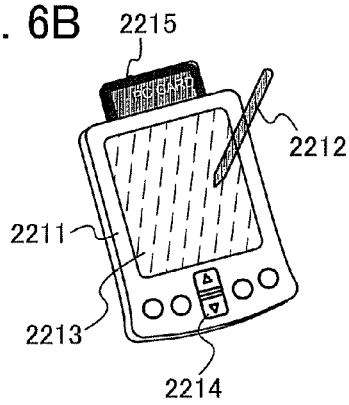

FIG. 6B illustrates a personal digital assistant (PDA), which includes a main body 2211 having a display portion 2213, an external interface 2215, an operation button 2214, and the like. A stylus 2212 for operation is included as an accessory.

Figure 6C:
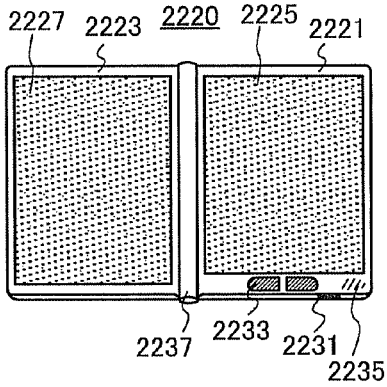

FIG. 6C illustrates an e-book reader 2220 as an example of electronic paper. The e-book reader 2220 includes two housings, a housing 2221 and a housing 2223. The housings 2221 and 2223 are bound with each other by an axis portion 2237, along which the e-book reader 2220 can be opened and closed. With such a structure, the e-book reader 2220 can be used as paper books.

A display portion 2225 is incorporated in the housing 2221, and a display portion 2227 is incorporated in the housing 2223. The display portion 2225 and the display portion 2227 may display one image or different images. In the structure where the display portions display different images from each other, for example, the right display portion (the display portion 2225 in FIG. 6C) can display text and the left display portion (the display portion 2227 in FIG. 6C) can display images.

Further, in FIG. 6C, the housing 2221 is provided with an operation portion and the like. For example, the housing 2221 is provided with a power supply 2231, an operation key 2233, a speaker 2235, and the like. With the operation key 2233, pages can be turned. Note that a keyboard, a pointing device, or the like may also be provided on the surface of the housing, on which the display portion is provided. Furthermore, an external connection terminal (an earphone terminal, a USB terminal, a terminal that can be connected to an AC adapter or various cables such as a USB cable, or the like), a recording medium insertion portion, and the like may be provided on the back surface or the side surface of the housing. Further, the e-book reader 2220 may have a function of an electronic dictionary.

The e-book reader 2220 may be configured to transmit and receive data wirelessly. Through wireless communication, desired book data or the like can be purchased and downloaded from an electronic book server.

Note that electronic paper can be applied to devices in a variety of fields as long as they display information. For example, electronic paper can be used for posters, advertisement in vehicles such as trains, display in a variety of cards such as credit cards, and the like in addition to e-book readers.

Figure 6D:
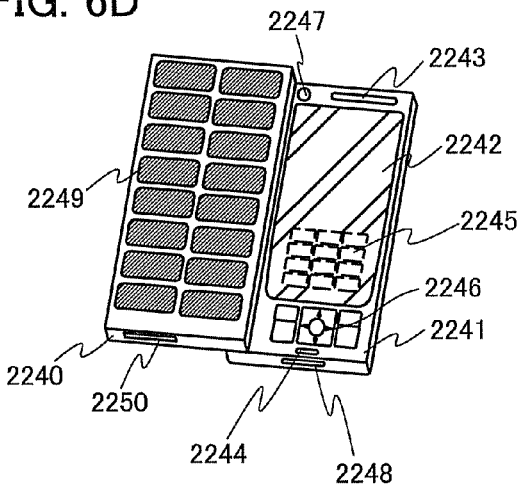

FIG. 6D illustrates a mobile phone. The mobile phone includes two housings, housings 2240 and 2241. The housing 2241 is provided with a display panel 2242, a speaker 2243, a microphone 2244, a pointing device 2246, a camera lens 2247, an external connection terminal 2248, and the like. The housing 2240 is provided with a solar cell 2249 charging of the mobile phone, an external memory slot 2250, and the like. An antenna is incorporated in the housing 2241.

The display panel 2242 has a touch panel function. A plurality of operation keys 2245 which are displayed as images is illustrated by dashed lines in FIG. 6D. Note that the mobile phone includes a booster circuit for increasing a voltage output from the solar cell 2249 to a voltage needed for each circuit. Moreover, the mobile phone can include a contactless IC chip, a small recording device, or the like in addition to the above structure.

The display orientation of the display panel 2242 changes as appropriate in accordance with the application mode. Further, the camera lens 2247 is provided on the same surface as the display panel 2242, and thus it can be used as a video phone. The speaker 2243 and the microphone 2244 can be used for videophone calls, recording, and playing sound, etc. as well as voice calls. Moreover, the housings 2240 and 2241 in a state where they are developed as illustrated in FIG. 6D can be slid so that one is lapped over the other; therefore, the size of the mobile phone can be reduced, which makes the mobile phone suitable for being carried.

The external connection terminal 2248 can be connected to an AC adapter or a variety of cables such as a USB cable, which enables charging of the mobile phone and data communication. Moreover, a larger amount of data can be saved and moved by inserting a recording medium to the external memory slot 2250. Further, in addition to the above functions, an infrared communication function, a television reception function, or the like may be provided.

Figure 6E:
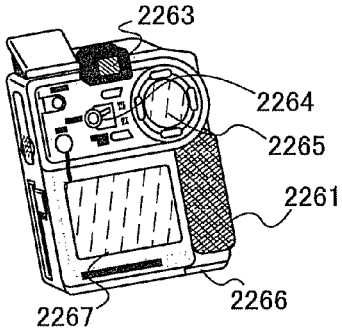

FIG. 6E illustrates a digital camera. The digital camera includes a main body 2261, a display portion (A) 2267, an eyepiece 2263, an operation switch 2264, a display portion (B) 2265, a battery 2266, and the like.

Figure 6F:
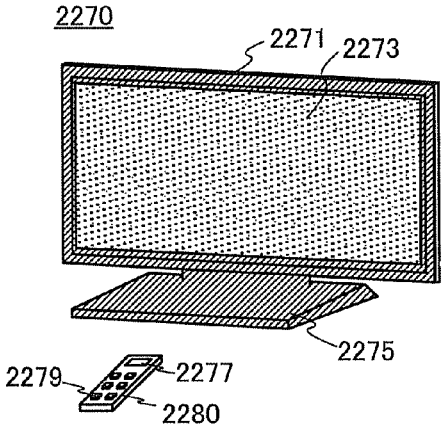

FIG. 6F illustrates a television set. In a television set 2270, a display portion 2273 is incorporated in a housing 2271. The display portion 2273 can display images. Here, the housing 2271 is supported by a stand 2275.

The television set 2270 can be operated by an operation switch of the housing 2271 or a separate remote controller 2280. Channels and volume can be controlled with an operation key 2279 of the remote controller 2280 so that an image displayed on the display portion 2273 can be controlled. Moreover, the remote controller 2280 may have a display portion 2277 in which the information outgoing from the remote controller 2280 is displayed.

Note that the television set 2270 is preferably provided with a receiver, a modem, and the like. A general television broadcast can be received with the receiver. Moreover, when the television set is connected to a communication network with or without wires via the modem, one-way (from a sender to a receiver) or two-way (between a sender and a receiver or between receivers) data communication can be performed.

This application is based on Japanese Patent Application serial no. 2011-172236 filed with Japan Patent Office on Aug. 5, 2011, the entire contents of which are hereby incorporated by reference.

What is claimed is:

1. A display device comprising:

a light-emitting element;

an n-channel driving transistor;

a capacitor;

a constant current source;

a first switch;

a second switch; and a third switch, wherein one terminal of the first switch is electrically connected to a gate of the n-channel driving transistor and the other terminal of the first switch is electrically connected to one electrode of the capacitor, wherein one terminal of the second switch is electrically connected to a source of the n-channel driving transistor, and the other terminal of the second switch is electrically connected to an anode of the light-emitting element, wherein one terminal of the third switch is electrically connected to the source of the n-channel driving transistor and the other electrode of the capacitor, and the other terminal of the third switch is electrically connected to the constant current source, wherein in a writing period, the first switch and the second switch are off, the third switch is on, the n-channel driving transistor is operated in a saturation region, an image signal is input to the one electrode of the capacitor, and a potential which has substantially the same level as a potential of the source of the n-channel driving transistor is input to the other electrode of the capacitor, and wherein in a display period after the writing period, the first switch and the second switch are on, the third switch is off, a node where the one electrode of the capacitor and the gate of the n-channel driving transistor are electrically connected to each other is made in a floating state, and a voltage which has substantially the same level as a difference between the image signal and the potential of the source of the n-channel driving transistor in the writing period is kept as a voltage between the gate and the source of the n-channel driving transistor.

2. The display device according to claim 1, wherein the first to third switches are transistors having the same polarity as the n-channel driving transistor.

3. The display device according to claim 1, wherein the first to third switches are each a transistor in which a channel is formed in an oxide semiconductor.

4. The display device according to claim 1, wherein the n-channel driving transistor is a normally-on transistor.

5. The display device according to claim 1, further comprising:

a fourth switch; and a fifth switch, wherein one terminal of the fourth switch is electrically connected to the one electrode of the capacitor, wherein one terminal of the fifth switch is electrically connected to the gate of the n-channel driving transistor, wherein in the writing period, the fourth switch and the fifth switch are on, the image signal is input to the one electrode of the capacitor via the fourth switch, and a signal which operates the n-channel driving transistor in the saturation region is input to the gate of the n-channel driving transistor via the fifth switch, and wherein in the display period, the node where the one electrode of the capacitor and the gate of the n-channel driving transistor are electrically connected to each other is made in a floating state by turning off the fourth switch and the fifth switch.

6. The display device according to claim 1, further comprising:

a fourth switch; and a fifth switch, wherein one terminal of the fourth switch is electrically connected to the one electrode of the capacitor, wherein one terminal of the fifth switch is electrically connected to the gate of the n-channel driving transistor, wherein in the writing period, the fourth switch and the fifth switch are on, the image signal is input to the one electrode of the capacitor via the fourth switch, and a signal which operates the n-channel driving transistor in the saturation region is input to the gate of the n-channel driving transistor via the fifth switch, and wherein in the display period, the node where the one electrode of the capacitor and the gate of the n-channel driving transistor are electrically connected to each other is made in a floating state by turning off the fourth switch and the fifth switch, and wherein the first to fifth switches are transistors having the same polarity as the n-channel driving transistor.

7. The display device according to claim 1, further comprising:

a fourth switch; and a fifth switch, wherein one terminal of the fourth switch is electrically connected to the one electrode of the capacitor, wherein one terminal of the fifth switch is electrically connected to the gate of the n-channel driving transistor, wherein in the writing period, the fourth switch and the fifth switch are on, the image signal is input to the one electrode of the capacitor via the fourth switch, and a signal which operates the n-channel driving transistor in the saturation region is input to the gate of the n-channel driving transistor via the fifth switch, and wherein in the display period, the node where the one electrode of the capacitor and the gate of the n-channel driving transistor are electrically connected to each other is made in a floating state by turning off the fourth switch and the fifth switch, and wherein the first to fifth switches are each a transistor in which a channel is formed in an oxide semiconductor.

8. A display device comprising:

a light-emitting element;

a p-channel driving transistor;

a capacitor;

a constant current source;

a first switch;

a second switch; and a third switch, wherein one terminal of the first switch is electrically connected to a gate of the p-channel driving transistor, and the other terminal of the first switch is electrically connected to one electrode of the capacitor, wherein one terminal of the second switch is electrically connected to a source of the p-channel driving transistor, and the other terminal of the second switch is electrically connected to a cathode of the light-emitting element, wherein one terminal of the third switch is electrically connected to the source of the p-channel driving transistor and the other electrode of the capacitor, and the other terminal of the third switch is electrically connected to the constant current source, wherein in a writing period, the first switch and the second switch are off, the third switch is on, the p-channel driving transistor is operated in a saturation region, an image signal is input to the one electrode of the capacitor, and a potential which has substantially the same level as a potential of the source of the p-channel driving transistor is input to the other electrode of the capacitor, and wherein in a display period after the writing period, the first switch and the second switch are on, the third switch is off, a node where the one electrode of the capacitor and the gate of the p-channel driving transistor are electrically connected to each other is made in a floating state, and a voltage which has substantially the same level as a difference between the image signal and the potential of the source of the p-channel driving transistor in the writing period is kept as a voltage between the gate and the source of the p-channel driving transistor.

9. The display device according to claim 8, wherein the first to third switches are transistors having the same polarity as the p-channel driving transistor.

10. The display device according to claim 8, wherein the first to third switches are each a transistor in which a channel is formed in an oxide semiconductor.

11. The display device according to claim 8, wherein the p-channel driving transistor is a normally-on transistor.

12. The display device according to claim 8, further comprising:

a fourth switch; and a fifth switch, wherein one terminal of the fourth switch is electrically connected to the one electrode of the capacitor, wherein one terminal of the fifth switch is electrically connected to the gate of the p-channel driving transistor, wherein in the writing period, the fourth switch and the fifth switch are on, the image signal is input to the one electrode of the capacitor via the fourth switch, and a signal which operates the p-channel driving transistor in the saturation region is input to the gate of the p-channel driving transistor via the fifth switch, and wherein in the display period, the node where the one electrode of the capacitor and the gate of the p-channel driving transistor are electrically connected to each other is made in a floating state by turning off the fourth switch and the fifth switch.

13. The display device according to claim 8, further comprising:

a fourth switch; and a fifth switch, wherein one terminal of the fourth switch is electrically connected to the one electrode of the capacitor, wherein one terminal of the fifth switch is electrically connected to the gate of the p-channel driving transistor, wherein in the writing period, the fourth switch and the fifth switch are on, the image signal is input to the one electrode of the capacitor via the fourth switch, and a signal which operates the p-channel driving transistor in the saturation region is input to the gate of the p-channel driving transistor via the fifth switch, and wherein in the display period, the node where the one electrode of the capacitor and the gate of the p-channel driving transistor are electrically connected to each other is made in a floating state by turning off the fourth switch and the fifth switch, and wherein the first to fifth switches are transistors having the same polarity as the p-channel driving transistor.

14. The display device according to claim 8, further comprising:

a fourth switch; and a fifth switch, wherein one terminal of the fourth switch is electrically connected to the one electrode of the capacitor, wherein one terminal of the fifth switch is electrically connected to the gate of the p-channel driving transistor, wherein in the writing period, the fourth switch and the fifth switch are on, the image signal is input to the one electrode of the capacitor via the fourth switch, and a signal which operates the p-channel driving transistor in the saturation region is input to the gate of the p-channel driving transistor via the fifth switch, and wherein in the display period, the node where the one electrode of the capacitor and the gate of the p-channel driving transistor are electrically connected to each other is made in a floating state by turning off the fourth switch and the fifth switch, and wherein the first to fifth switches are each a transistor in which a channel is formed in an oxide semiconductor.

15. A display device comprising:

a light-emitting element;

a driving transistor in which a channel is formed in an oxide semiconductor;

a capacitor;

a constant current source;

a first switch;

a second switch; and a third switch, wherein one terminal of the first switch is electrically connected to a gate of the driving transistor, and the other terminal of the first switch is electrically connected to one electrode of the capacitor, wherein one terminal of the second switch is electrically connected to a source of the driving transistor, and the other terminal of the second switch is electrically connected to an anode of the light-emitting element, wherein one terminal of the third switch is electrically connected to the source of the driving transistor and the other electrode of the capacitor, and the other terminal of the third switch is electrically connected to the constant current source, wherein in a writing period, the first switch and the second switch are off, the third switch is on, the driving transistor is operated in a saturation region, an image signal is input to the one electrode of the capacitor, and a potential which has substantially the same level as a potential of the source of the driving transistor is input to the other electrode of the capacitor, and wherein in a display period after the writing period, the first switch and the second switch are on, the third switch is off, a node where the one electrode of the capacitor and the gate of the driving transistor are electrically connected to each other is made in a floating state, and a voltage which has substantially the same level as a difference between the image signal and the potential of the source of the driving transistor in the writing period is kept as a voltage between the gate and the source of the driving transistor.

16. The display device according to claim 15, wherein the first to third switches are transistors having the same polarity as the driving transistor.

17. The display device according to claim 15, wherein the first to third switches are each a transistor in which a channel is formed in an oxide semiconductor.

18. The display device according to claim 15, wherein the driving transistor is a normally-on transistor.

19. The display device according to claim 15, further comprising:

a fourth switch; and a fifth switch, wherein one terminal of the fourth switch is electrically connected to the one electrode of the capacitor, wherein one terminal of the fifth switch is electrically connected to the gate of the driving transistor, wherein in the writing period, the fourth switch and the fifth switch are on, the image signal is input to the one electrode of the capacitor via the fourth switch, and a signal which operates the driving transistor in the saturation region is input to the gate of the driving transistor via the fifth switch, and wherein in the display period, the node where the one electrode of the capacitor and the gate of the driving transistor are electrically connected to each other is made in a floating state by turning off the fourth switch and the fifth switch.

20. The display device according to claim 15, further comprising:

a fourth switch; and a fifth switch, wherein one terminal of the fourth switch is electrically connected to the one electrode of the capacitor, wherein one terminal of the fifth switch is electrically connected to the gate of the driving transistor, wherein in the writing period, the fourth switch and the fifth switch are on, the image signal is input to the one electrode of the capacitor via the fourth switch, and a signal which operates the driving transistor in the saturation region is input to the gate of the driving transistor via the fifth switch, wherein in the display period, the node where the one electrode of the capacitor and the gate of the driving transistor are electrically connected to each other is made in a floating state by turning off the fourth switch and the fifth switch, and wherein the first to fifth switches are transistors having the same polarity as the driving transistor.

21. The display device according to claim 15, further comprising:

a fourth switch; and a fifth switch, wherein one terminal of the fourth switch is electrically connected to the one electrode of the capacitor, wherein one terminal of the fifth switch is electrically connected to the gate of the driving transistor, wherein in the writing period, the fourth switch and the fifth switch are on, the image signal is input to the one electrode of the capacitor via the fourth switch, and a signal which operates the driving transistor in the saturation region is input to the gate of the driving transistor via the fifth switch, wherein in the display period, the node where the one electrode of the capacitor and the gate of the driving transistor are electrically connected to each other is made in a floating state by turning off the fourth switch and the fifth switch, and wherein the first to fifth switches are each a transistor in which a channel is formed in an oxide semiconductor.

* * * * *